US006493965B1

(12) United States Patent
Bathum

(10) Patent No.: US 6,493,965 B1
(45) Date of Patent: Dec. 17, 2002

(54) SANDAL WITH TOE GUARD

(75) Inventor: Dale Bathum, Redmond, WA (US)

(73) Assignee: Bite, LLC, Preston, WA (US)

( * ) Notice: Subject to any disclaimer, the term of this patent is extended or adjusted under 35 U.S.C. 154(b) by 0 days.

(21) Appl. No.: 09/657,729

(22) Filed: Sep. 8, 2000

(51) Int. Cl.[7] ..... A43B 3/12; A43B 3/10; A43C 13/00

(52) U.S. Cl. ..... 36/11.5; 36/7.5; 36/72 R; 36/96; 36/7.7; 36/77 R

(58) Field of Search ..... 36/11.5, 7.5, 8.1, 36/96, 94, 7.7, 7.6, 4, 77 R, 70 R, 72 R

(56) References Cited

U.S. PATENT DOCUMENTS 1,205,983 A * 11/1916 Emmerth ..... 36/7.5
1,386,028 A * 8/1921 Roe ..... 36/7.6
2,327,322 A * 8/1943 Slater ..... 36/11.5
3,613,272 A * 10/1971 Fukuoka ..... 36/4
3,834,377 A * 9/1974 Lebold ..... 36/7.5
4,177,583 A * 12/1979 Chapman ..... 36/77 R
4,535,554 A * 8/1985 De Obaldia ..... 36/11.5
5,331,751 A * 7/1994 Harwood ..... 36/77 R
5,836,090 A * 11/1998 Smith ..... 36/7.6
6,237,249 B1 * 5/2001 Aguerre ..... 36/11.5

* cited by examiner

*Primary Examiner*—Anthony D. Stashick
(74) *Attorney, Agent, or Firm*—Marvin E. Jacobs

(57) ABSTRACT

A toe guard for an open toe sandal is presented. The toe guard is formed of a curved panel of rigid plastic extending around and over the front toe portion of the foot bed of the sandal and can have a base wall disposed between an upper innersole and a lower outersole.

12 Claims, 2 Drawing Sheets

SANDAL WITH TOE GUARD

TECHNICAL FIELD

This invention relates generally to footwear and more specifically to an improvement in a sport sandal upper that enhances comfort and safety of the sandal.

BACKGROUND OF THE INVENTION

Sandals constitute one of the earliest footwear known to man. Typically, sandals incorporate either a leather or rubberized sole which can be attached to the human foot by straps extending across the Achilles heel and toes of the user. Prior art sandals were designed for walking. Sandals however, have been recently developed for more demanding sports-related activities on land, paved surfaces and in water as represented by U.S. Pat. No. 5,651,195 ('195) and U.S. Pat. No. 5,687,492 ('492).

Sandals are generally classified as either "closed-heel" or "open-heel". "Open-heel" sandals are typically provided with a single strap that passes over the wearer's foot above the bridge, or a combination of a strap with toe-thong that extends from a strap over the bridge of a wearer's foot to the sole of the sandal, and which is generally positioned between two of the wearer's toes. "Closed-heel" sandals typically include a strap or upper portion positioned behind the wearer's heel to support the wearer's foot within the sandal. Both types of sandals usually have an open toe structure.

This invention relates to open toe sandals. An open toe sandal, especially when absent a toe thong permits the foot to slide forwardly when the sandal is planted during walking, running, climbing and especially when stopping quickly. The sole of the foot will slide forwardly and toes can extend beyond the front end of the sole causing chafing, blisters on the sole of the foot and on the skin surfaces under the straps of the sandal. The toes are also exposed to being hit with rocks or sand kicked up by the runner, bicyclist or the like in front of the wearer of the sandal or during walking or playing on a beach or in the surf. Water sports such as kayaking, rafting also expose the toes to injury when wearing an open toe sandal.

The problem of the foot sliding forward in an open toe sandal has been addressed by improvements in the straps across the front of the ankles and across the front to the foot. The upper surface of the innersole of sandals has been relieved and contoured to stabilize the foot from linear movement. Also the front portion of the innersole has been relieved to form an upwardly sloping ramp which receives the bottom of the front portion of the foot including the toes. All of these measures provide some improved linear stability but are not adequate to hold the foot in place during quick stops or turns.

STATEMENT OF THE INVENTION

The present invention prevents injury to the foot and toes in an open toe sandal. Linear and transverse stability are both improved by the present invention.

The present invention comprises an upraised toe guard which is positioned on the front, marginal lip of the sandal. The guard extends laterally from the side of the big toe around to the side edge of the small toe. The guard extends rearwardly at least to front edge of the nails usually no further rearwardly then the start of the toes. The guard need not extend rearwardly past the rear joint of the big and small toes. The toe guard of the invention slants vertically upwardly and rearwardly, preferably in a curved profile to form a shield and cover over the front toes. The rear edge of the toe guard extends rearwardly at least to the front of the toes and need not extend past the rear joint of each toe. The upper lip of the toe guard preferably extends rearwardly a greater amount in the area above the big and adjacent toe and decreases in width as it continues toward the inner and outer edges of the sandal.

The toe guard can be rigid or soft. It is preferably formed of a fairly rigid plastic material such as Hytrel®. The toe guard can be attached to the front lip of an open toe sandal. It is preferred that toe guard has a base wall that can be positioned between an upper innersole and a lower outer sole during the step of adhering the innersole to the outer sole. In the case of use of an innersole with an upwardly slanted, curved ramp, the curved toe guard extends above and over the curved ramp.

These and many other attend features and advantages of the invention will become better understood as the invention becomes better understood by reference to the following detailed descriptions when considered in conjunction with the accompanying drawings.

DETAILED DESCRIPTION OF THE INVENTION

Figure 1:
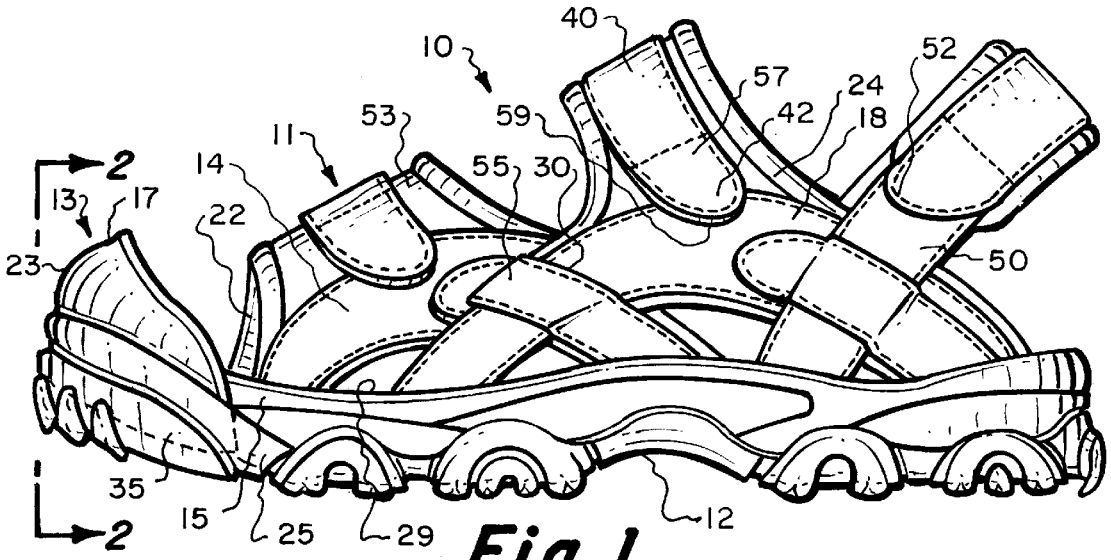
FIG. 1 is a side view in elevation of the inner-arch side of a sandal with toe guard according to the invention.
Figure 2:
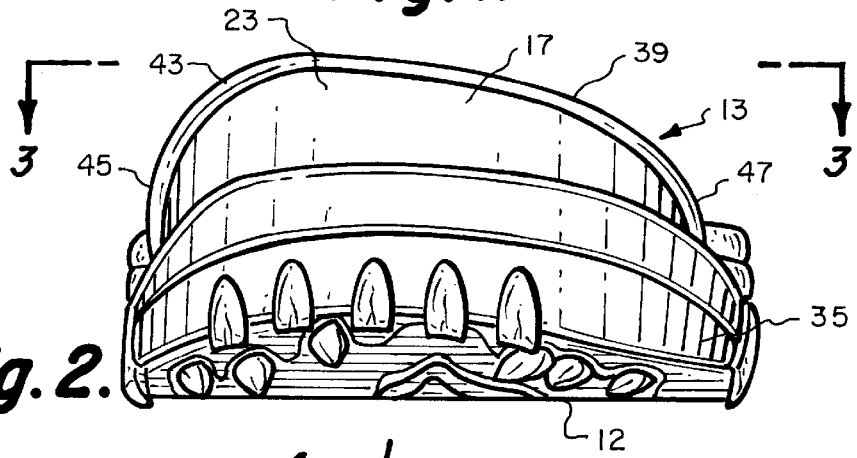
FIG. 2 is a front view in elevation of the sandal.
Figure 3:
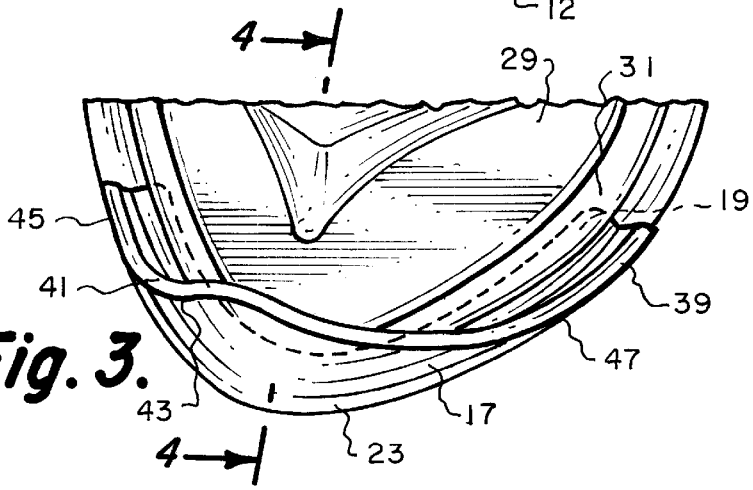
FIG. 3 is a view in section taken along line 3—3 of FIG. 2.
Figure 4:
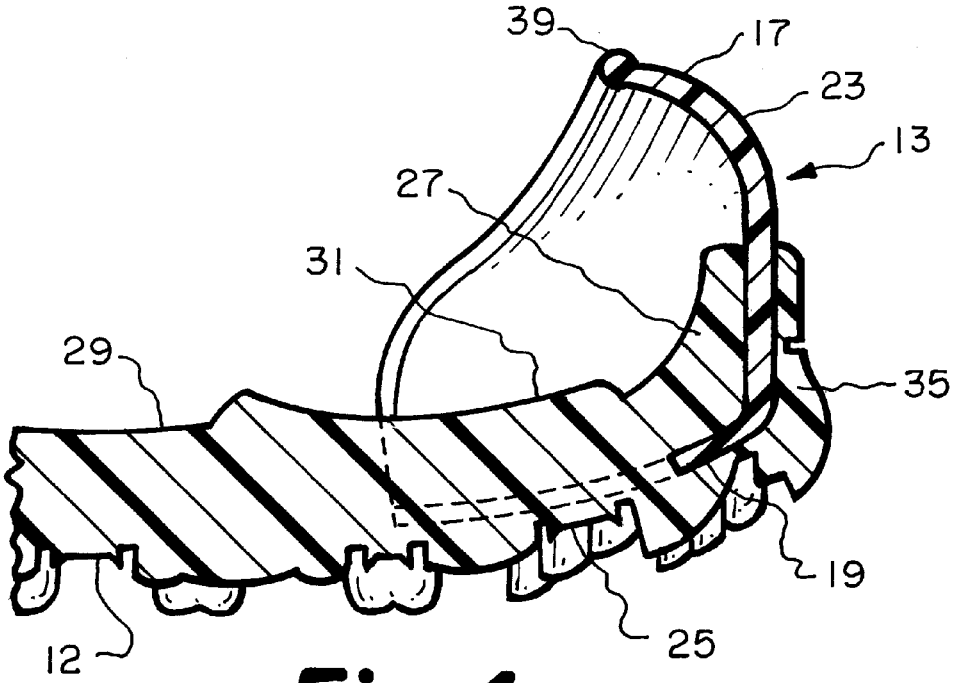
FIG. 4 is a view in section taken along line 4—4 of FIG. 3.
Figure 5:
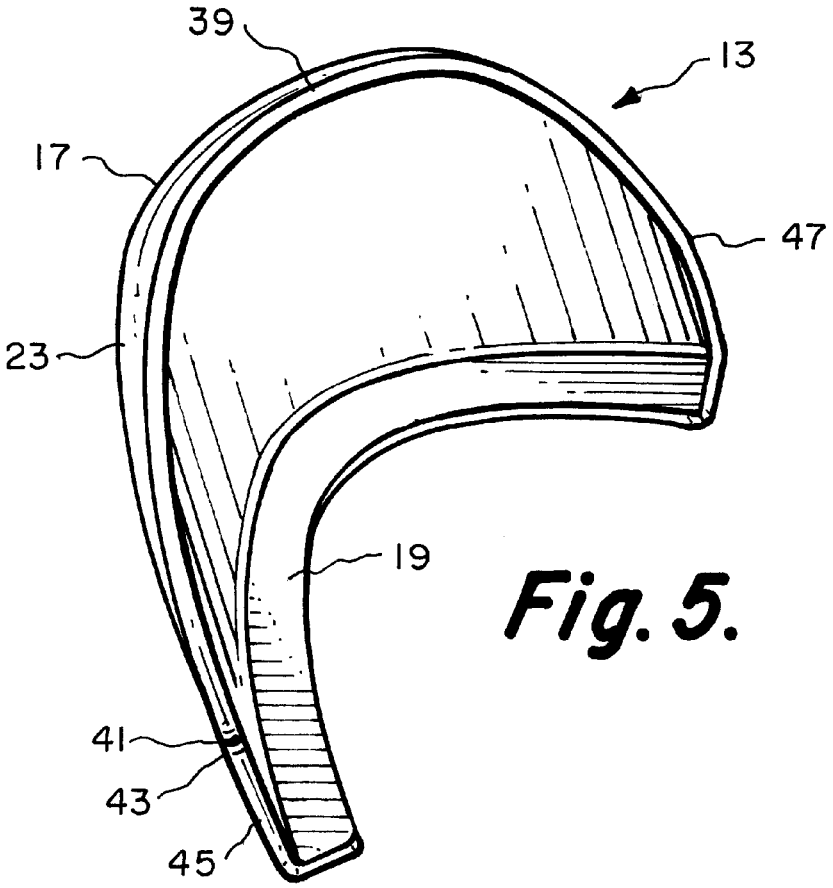
FIG. 5 is an isometric view of the toe guard of the invention.

Referring now to FIGS. 1–5, a sandal 10 according to the invention comprises a sole 12 and an upper open toe configuration 11 and a toe guard 13. The upper configuration can comprise a front pair of support straps 14; and a rear pair of support straps 18, each pair having their respective straps positioned on opposing lateral sides of the sole 12. Each strap is anchored at both ends to the sole 12 and have a generally arc-shaped configuration. Straps 14 and 18 are constructed of a durable material such as leather.

The toe guard 13 is positioned at the front end 15 of the sandal 10 and comprises a rearwardly curved wall 17 extending upwardly in front of the position of the toes of the wearer, not shown. The guard is formed of a tough plastic such as Hytrel®. The wall 17 shields the front and nail area of the toes from collision with hard objects such as walls, road surfaces, rocks, etc. The wall 17 has a lower mounting portion 19 and an upper shield portion 23. The lower portion 19 is disposed between and outer front marginal lip 35 of the outer sole 25, sole 12 and an inner raised ramp 27 of the innersole 29. To further increase stability of the toe guard 13, the toe guard can be provided with a base wall 31. During assembly of the innersole 29 and the outersole 25, the toe guard is inserted between the innersole 29 and outersole 25 with the lower portion 19 between the lip 35 and ramp 27 and the base wall 31 between the soles 25, 29. As the soles 25, 29 are adhered together by heat and/or adhesive to form the sole 12 the toe guard 13 is firmly secured in place.

The lateral curve of the toe guard 13 follows the front profile of the last or sole 12 of the sandal 10. The upper shield portion 23 of the curved wall 17 extends upwardly a distance sufficient to cover the big toes, not shown. The big toe and adjacent toe are the longest and the portion 39 of the wall 23 is the highest and deepest in front of these toes. A lip 41 of the wall 17 is formed by a small wall portion 43 extending forwardly from the inner end 45 of the wall 17 to the wall portion 39 and a longer wall portion 47 extending from the wall portion 39 rearwardly to the outer end of the wall 17.

The toe guard 13 forms a partial cap protecting the toes of the wearer. It could extend rearwardly to the ends of the toes. However, since a sandal is an open air type of footwear, the wall 17 need only extend rearwardly sufficient to shield debris. The toe guard usually extends no further rearwardly then the front of the toes and preferably no further rearwardly then the start of the nail beds of the toes.

A layer of tear resistant cushion material 22 can be attached to the inside surface of the straps 14 and 18. The part of cushion material 22 not attached to either strap 14 and 18 defines a center portion 53 and further defines an open space between cushion material 22 and sole 12 for a user's foot to pass through.

Besides straps 14 and 18 being connected to each other by cushion material 22 and straps 18 being connected by cushion material 24, the straps on each lateral side of sole 12 can be attached to one another; namely front strap 14 to rear strap 18.

The preferred means for connecting the front and rear straps on each lateral side is by a slit 30 cut though one strap and its corresponding cushion layer. There is no preference as to whether slits 30 are in front straps 14 or on the rear straps 18. However, for purposes of illustration, slits 30 are located in front straps 14, and their associated cushion layer 22. Rear straps 18, and their associated cushion layer 24 are inserted through their respective slits 30 on front straps 14 producing an interlocking or weave connection 55 between the respective front and rear straps. The weave connection of strap material depicted as 55 provides additional lateral upper support.

To firmly secure the sandal 10 to a wearer's foot, three straps are utilized; all of which can incorporate strips of hook and loop fastener 57, 59 (such as a Velcro® fastener) affixed to the facing surfaces of each strap.

Likewise, an ankle strap 40 can be used to tighten the rear pair of opposing lateral straps 18 about the front of the wearer's ankle. The ankle strap 40 is attached to either rear strap 18 while the other rear strap can be attached to a coupling means. The ankle strap 40 has a free end 42 which is inserted though coupling means, not shown, back over itself and temporarily secured by coupling the strips 57, 59 of hook and loop material found on facing surfaces of the ankle strap 40.

A heel strap 50 can be used to tighten the rear pair of opposing lateral straps 18 about the wearer's ankle with the strap wrapping around the wearer's heel or Achilles tendon to provide support and prevent the user's foot from slipping out from the rear of the sandal. As with the ankle strap 40, the heel strap 50 is attached to either rear strap 18 while the other rear strap has attached a similar coupling means as described for the front strap. The heel strap 50 has a free end 52 which is inserted though the coupling means and back over itself and temporarily secured by coupling the strips of hook and loop material found on facing surfaces of the heel strap 50.

Many other configurations are possible, the heel strap can be attached on one end to one of the rear straps. The free end has hook or loop material. The other rear strap has hook or loop material on its outer surface so that the free end of the heel strap can wrap around the wear's heel and engage the hook or loop material found on the other rear strap.

In another configuration, the heel strap incorporates at least two rings, one attached on each rear strap. The heel strap is attached on one of the rear straps, and looped across and through the first ring which is secured to the other rear strap, then back across to the rear strap to which it is attached and looped through a second ring positioned on the rear strap but above the strap end attachment and thereafter across and over to loop material attached on the other rear strap.

It is to be realized that only preferred embodiments of the invention have been described, and it is intended that numerous substitutions, modifications, alterations may be made without departing from the spirit and scope of the invention as defined in the following claims.

What is claimed is:

1. An open-toed sandal for receiving a foot of a wearer, the foot having toes, and a heel, comprising:

a foot bed with a toe portion and a heel portion, the foot bed being shaped and sized to support the wearer's-foot with the toes adjacent to the toe portion have a curved front edge portion positioned to be forward of the wearer's toes when the wearer's foot is supported on the foot bed;

a foot-strap coupled to the foot bed;

a separate toe guard comprising an arcuate guard plate having a bottom edge portion shaped to be adjacent to the toe portion connected to the foot bed only along the curved front edge portion, a curved top edge portion spaced apart from the bottom edge portion, and side edge portions interconnecting the top and bottom edge portion, the guard plate's top edge portion being out of engagement with the foot bed and the foot strap and shaped to maintain an open-toes configuration of the sandal, the guard plate having a concave inner surface adapted to form a barrier in front of the wearer's toes.

2. The sandal according to claim 1 wherein the toe guard is formed by an arcuate plate member.

3. The sandal according to claim 1 wherein the toe guard is formed of a stiff plastic.

4. The sandal according to claim 1 wherein the foot strap is connected to the foot bed intermediate the toe portion and the heel portion.

5. The sandal according to claim 1, the wearer's toes have metatarsus and first row phalanges interconnected at first joints, and wherein the toe guard has side edge portions positioned adjacent to the foot bed at a position at or forward of the first joints when the wearer's foot is in the sandal.

6. The sandal according to claim 1 wherein the toe portion has a toe support area, the top edge of the toe guard being above the toe support area.

7. A toe guard for an open-toed sandal for receiving a foot of a wearer, the foot having toes, and a heel, the sandal having a foot bed with a toe portion and a heel portion, the toe portion having a curved front edge portion, and a foot-strap connected to the foot bed, comprising:

an arcuate guard plate having a bottom edge portion shaped to be connectable to the foot bed adjacent to the toe portion only along the curved front edge portion, a curved top edge portion spaced apart from the bottom edge portion, and side edge portions interconnecting the top and bottom edge portion, the guard plate's top edge portion being out of engagement with the foot bed and the foot strap and shaped to maintain an open-toes configuration of the sandal, the guard plate having a concave inner surface adapted to form a barrier in front of the wearer's toes.

8. The toe guard according to claim 7 wherein the concave inner surface of the guard plate is sized to extend upwardly over the toe portion.

9. The toe guard according to claim 7 wherein the guard plate formed of plastic.

10. The toe guard according to claim 7 wherein the guard plate's concave inner surface is sized to extend in front of all of the wearer's toes.

11. The toe guard according to claim 7 the wearer's toes have metatarsus and first row phalanges interconnected at first joints, and wherein the toe guard has side edge portions positionable adjacent to the foot bed at a position at or forward of the first joints when the wearer's foot is in the sandal.

12. The toe guard according to claim 7 wherein the guard plate is adjustably positionable with the top edge portion spaced apart from the foot bed a distance to avoid engagement with the wear's toes.

* * * * *